US010272561B2

(12) United States Patent
McGarry et al.

(10) Patent No.: US 10,272,561 B2
(45) Date of Patent: Apr. 30, 2019

(54) HYBRID SINGLE AND DOUBLE WALL CHAINSAW CASE

(71) Applicants: John McGarry, Clinton, IA (US); Pamela Jo Naeve, Clinton, IA (US); Michael Grinnall, Clinton, IA (US)

(72) Inventors: John McGarry, Clinton, IA (US); Pamela Jo Naeve, Clinton, IA (US); Michael Grinnall, Clinton, IA (US)

(73) Assignee: Custom-Pak, Inc., Clinton, IA (US)

( * ) Notice: Subject to any disclaimer, the term of this patent is extended or adjusted under 35 U.S.C. 154(b) by 1120 days.

(21) Appl. No.: 14/038,023

(22) Filed: Sep. 26, 2013

(65) Prior Publication Data

US 2015/0083620 A1 Mar. 26, 2015

(51) Int. Cl.
*B25H 3/00* (2006.01)
*B27B 17/00* (2006.01)

(52) U.S. Cl.
CPC ..... *B25H 3/006* (2013.01); *B27B 17/0008* (2013.01)

(58) Field of Classification Search
CPC ..... B25H 3/006; B27B 17/0008
USPC ..... 206/349, 745, 319; 425/535, 527, 296; 220/669, 675
See application file for complete search history.

(56) References Cited

U.S. PATENT DOCUMENTS

| | | | | |
|---|---|---|---|---|
| 4,371,079 | A * | 2/1983 | Dembicks | B27B 17/0008 206/349 |
| 6,659,276 | B2 | 12/2003 | Anderson et al. | |
| 6,793,074 | B2 | 9/2004 | Anderson et al. | |
| 7,455,513 | B2 | 11/2008 | Grinnall et al. | |
| 7,578,959 | B2 | 8/2009 | Bahnsen et al. | |
| 2003/0075467 | A1* | 4/2003 | Anderson et al. | 206/349 |
| 2006/0073290 | A1 | 4/2006 | Bahnsen et al. | |
| 2008/0111285 | A1 | 5/2008 | Bahnsen et al. | |
| 2013/0140860 | A1 | 6/2013 | Naughton et al. | |

* cited by examiner

*Primary Examiner* — King M Chu
(74) *Attorney, Agent, or Firm* — St. Onge Steward Johnston & Reens, LLC

(57) ABSTRACT

A hybrid double and single wall chainsaw case with two pivotally connected body portions that pivot between an open position and a closed position to respectively receive and contain a chainsaw. The peripheral side wall of one of the body portions has an opening for receiving a scabbard with an end portion, the end portion contacting the opening and the scabbard applied to the bar of the chainsaw. A portion of one of the body sections is configured as a double wall structure and a portion of one of the body sections is configured as a single wall structure.

22 Claims, 11 Drawing Sheets

Figure 11A
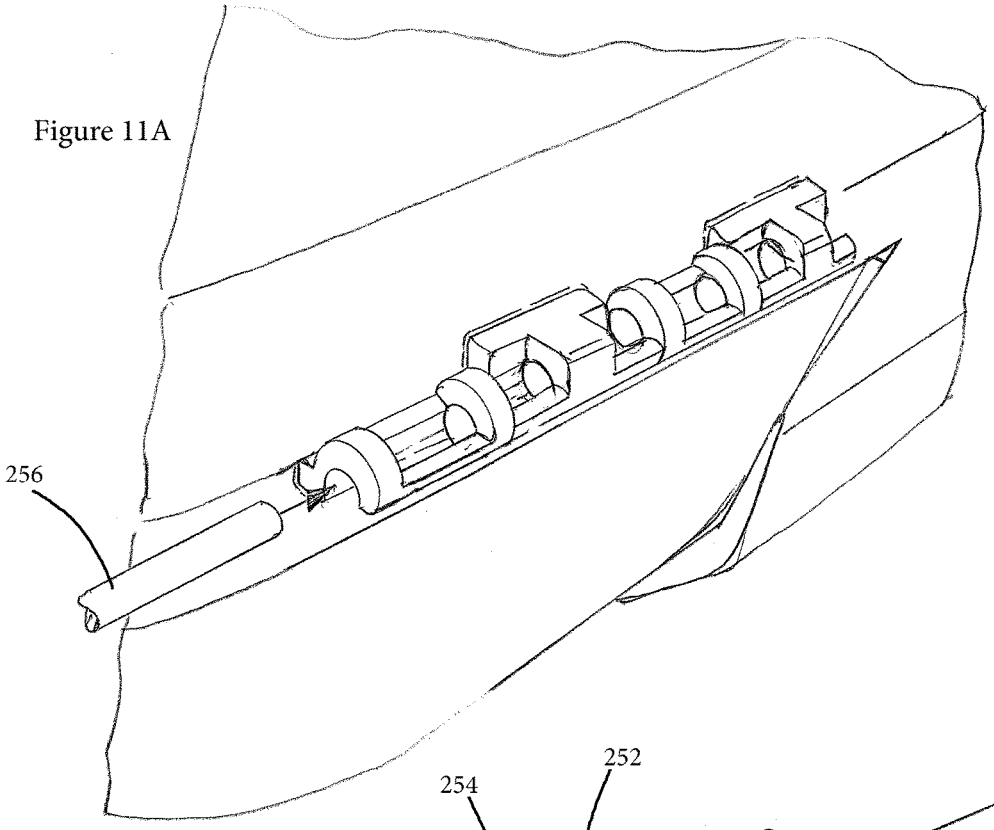
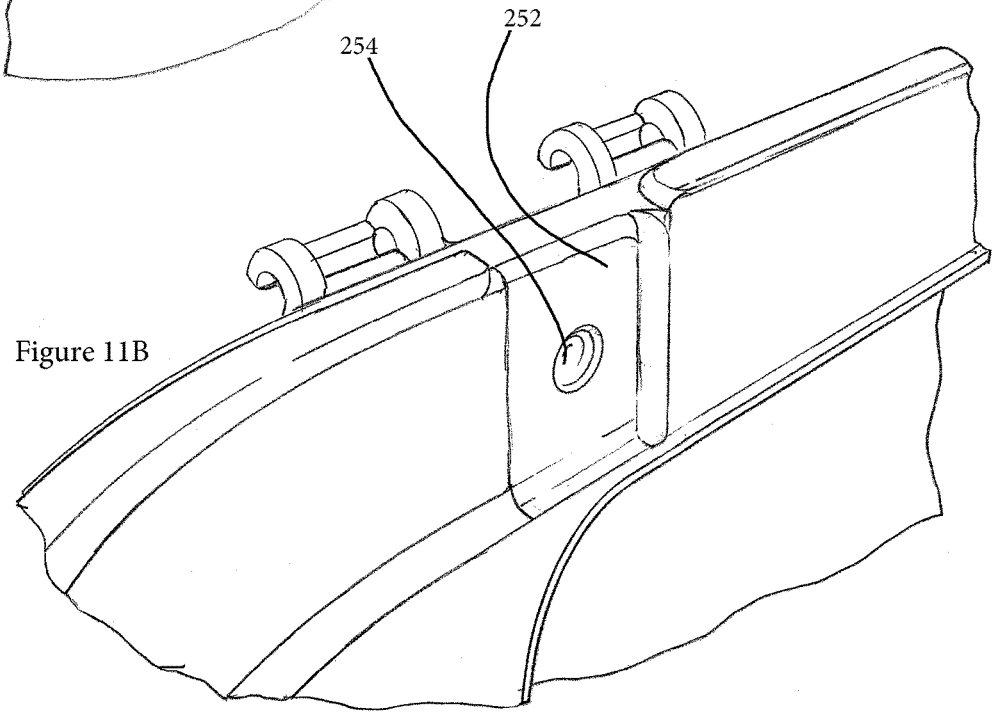
Figure 11B

HYBRID SINGLE AND DOUBLE WALL CHAINSAW CASE

FIELD OF THE INVENTION

The present invention is directed to a chainsaw case, and more particularly a blow molded chainsaw case

BACKGROUND OF THE INVENTION

Chainsaw cases have been used as reusable packaging for chainsaws since at least the early 1970s. Many of these cases are double wall blow molded carrying cases that protect the chainsaw from rough handling and also protect the sharp teeth of the chainsaw from dulling through unintentional bumping against hard or abrasive objects. Often, chainsaws can leak chain lubricating oils, or they can give off fumes associated with gasoline or oils. The chainsaw case will often include a drip pan that can catch and retain any oils that drip from the chainsaw.

Double wall cases may provide an advantage over single wall cases in that the double wall configuration provides a strong wall that can better support and protect the chainsaw. On the other hand, single wall cases provide the advantage of lower cost due to significantly less raw material use. In addition, single wall configurations impose a smaller footprint. This smaller footprint uses less space in shipping and on retail shelves, both of which may provide an economic advantage to single wall cases.

Examples of two prior art double wall chainsaw cases are shown in FIGS. 1 and 2. The two-piece case 10A, as shown in FIG. 1, consists of a lid portion 11 and a base portion 12 joined by a hinge 13. The lid portion 11 and the base portion 12, when closed completely, enclose the saw body and attached bar and chain assembly.

The three-piece case 10B, as shown in FIG. 2, consists of double wall lid portion 14 and base portion 15 hinged together, which, when dosed, enclose the saw body. The third piece is a separate scabbard 16, preferably of blow molded single wall construction. A section 17 adjacent to the open end of the scabbard 16 fits slideably into a slot 18 molded in the double wall base 15, or into opposing slots molded into both lid 14 and base 15. The sidewalls of the slot or slots 18 hold the scabbard 16 snugly in position in the closed case.

The body of these cases are double wall configurations. Although the scabbard of FIG. 2 may be of a single wall construction, the lid 14 and base 15 portions are both double wall configurations. The three piece case provides the advantage of a separate scabbard. The appropriate length scabbard may be selected depending on the bar length of the chainsaw. In addition, the separate scabbard allows for a smaller shipping package size in comparison to the two piece case, however it may be desirable to further reduce the shipping size and to reduce the material costs associated with manufacturing the case.

Therefore, what is desired is a chainsaw carrying case that reduces material costs and has a smaller footprint than prior art blow molded cases while still providing sufficient protection and support for the chainsaw.

SUMMARY OF THE INVENTION

Accordingly, it is an object of the present invention to provide a chainsaw case that uses less material to manufacture while providing sufficient strength to protect the chainsaw.

It is another object of the present invention to provide a chainsaw case with a smaller footprint.

It is yet another object of the present invention to provide a user friendly scabbard/body interface.

These and other objects are achieved by providing a hybrid double and single wall case for a chainsaw having a bar, the case having a first body portion and a second body portion, each having a base wall and a peripheral side wall. The peripheral side wall defines an edge. The first and second body portions are pivotally connected with respect to each other and pivot between an open position and a closed position. The open position allows the chainsaw to be positioned in the case, and the closed position contains at least a majority of the chainsaw within the case. The peripheral side wall of the first body portion has an opening with two side sections, the opening extends from the edge and towards the base wall. A scabbard has an end portion with two side sections, the side sections of the end portion are adapted to mate with the side sections of the opening. The scabbard can be applied to the bar of the chain saw, and the end portion is received in the opening. A portion of the first body section is configured as a double wall structure and a portion of the first body section is configured as a single wall structure.

Other objects are achieved by providing a hybrid double and single wall case for a chainsaw having a bar and at least one grip section at a proximal end. The case includes a first body portion and a second body portion, each having a base wall and a peripheral side wall. The peripheral side wall defines an edge and the first and second body portions are pivotally connected with respect to each other and adapted to pivot between an open position and a closed position. The open position allows the chainsaw to be positioned in the case, the closed position contains at least a majority of the chainsaw within the case. The peripheral side wall of the first body portion has an opening extending from the edge and towards the base. A scabbard having an end portion is adapted to be applied to the bar of the chain saw, and the end portion is adapted to be received within the opening. A portion of each of the first and second body sections is configured as a double wall structure and a portion each of the said first and second body sections is configured as a single wall structure. The portion of the second body section configured as a single wall structure creates at least one pocket surrounded by the double wall structure, each pocket receiving at least one of the grip sections.

Yet other objects are achieved by providing a hybrid double and single wall case for a chainsaw having a bar. The case includes a first body portion and a second body portion, each having a base wall and a peripheral side wall, the peripheral side wall defining an edge. The first and second body portions are pivotally connected with respect to each other and adapted to pivot between an open position and a closed position, the open position to allow the chainsaw to be positioned in the case, and the closed position to contain at least a majority of the chainsaw within the case. The peripheral side wall of the first body portion has an opening extending from the edge and towards the base. A scabbard with an end portion is adapted to be applied to the bar of the chain saw. The end portion is adapted to be received within the opening. A portion of the first body section is configured as a double wall structure and at least a majority, based on surface area, of the base wall of the first body portion is configured as a single wall structure.

The first body section of the carrying case can have an edge section adjacent to the edge of the peripheral side wall. The edge section is configured as a double wall structure. A section of the peripheral side wall adjacent to the edge section and between the edge section and the base wall is configured as a single wall structure.

The first body section can further have the peripheral side wall configured as a single wall structure, and the base wall configured as a double wall structure. A plurality of ribs are disposed between the base section and the peripheral side wall, the ribs connect the single wall structure to the double wall structure along a portion of the peripheral side wall that includes the opening.

The carrying case can further include at least one hinge member formed on at least one of the peripheral side walls of the second body portion. Each hinge member is disposed at a location where the at least one of the peripheral side walls is configured as a double wall structure.

At least one latch member can be formed on the peripheral side wall of one of the body portions. Each latch member is at a location where the at least one of the peripheral side walls is configured as a double wall structure.

The walls of the double wall structure can be bonded together at an area adjacent to the at least one hinge member. The walls of the double wall structure can be bonded together at an area adjacent to at least one latch member.

A handle can be connected to the second body portion. An inner wall of the second body portion is joined to an outer wall of the second body portion to create a joint at the handle. The handle extends into the second body portion and contacts the inner and outer wall at the joint.

In some cases at least one of the two side sections of the opening can be disposed at an angle to form a tapered section where a width of the opening at the edge is greater than a width of the opening closer to the base. In this case, the the end portion of the scabbard is tapered to correspond to the tapered angle of the opening.

BRIEF DESCRIPTION OF THE DRAWINGS

FIGS. 11A and 11B are respectively exterior and interior perspective detail views of the case of FIG. 3.

DETAILED DESCRIPTION OF THE INVENTION

Figure 1:
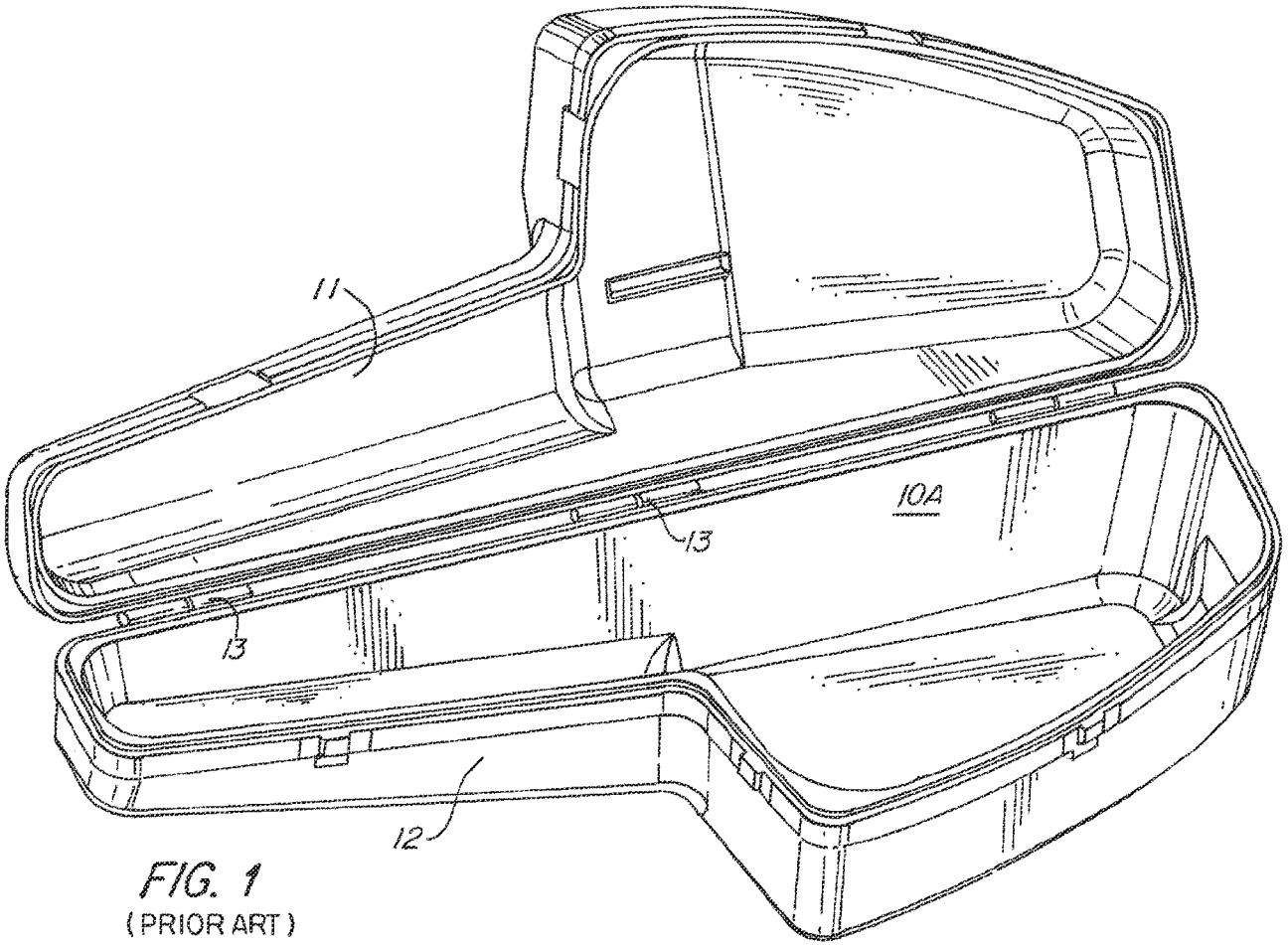
FIG. 1 (PRIOR ART)
FIG. 1 is a perspective view of a prior art double wall chainsaw case.
Figure 2:
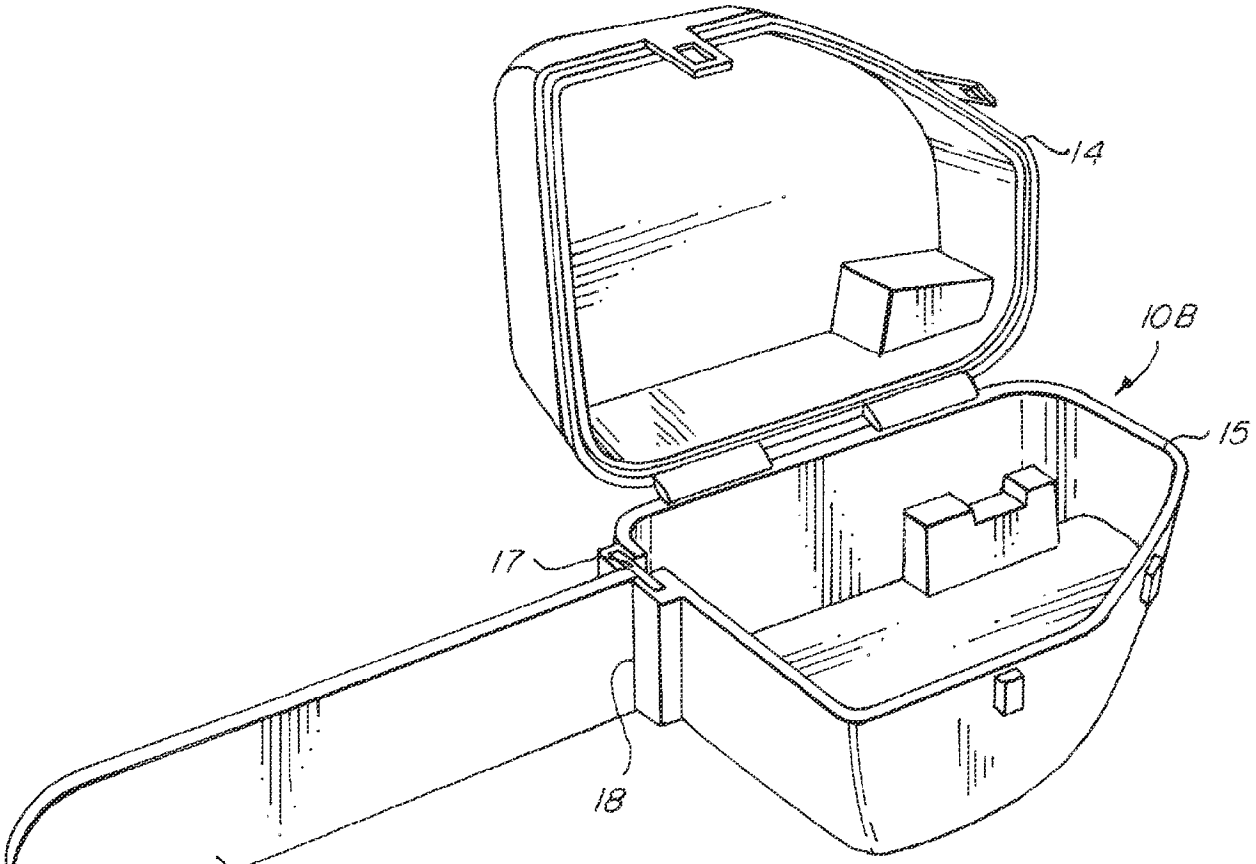
FIG. 2 (PRIOR ART)
FIG. 2 is a perspective view of another prior art double wall chainsaw case having a separate scabbard.
Figure 3:
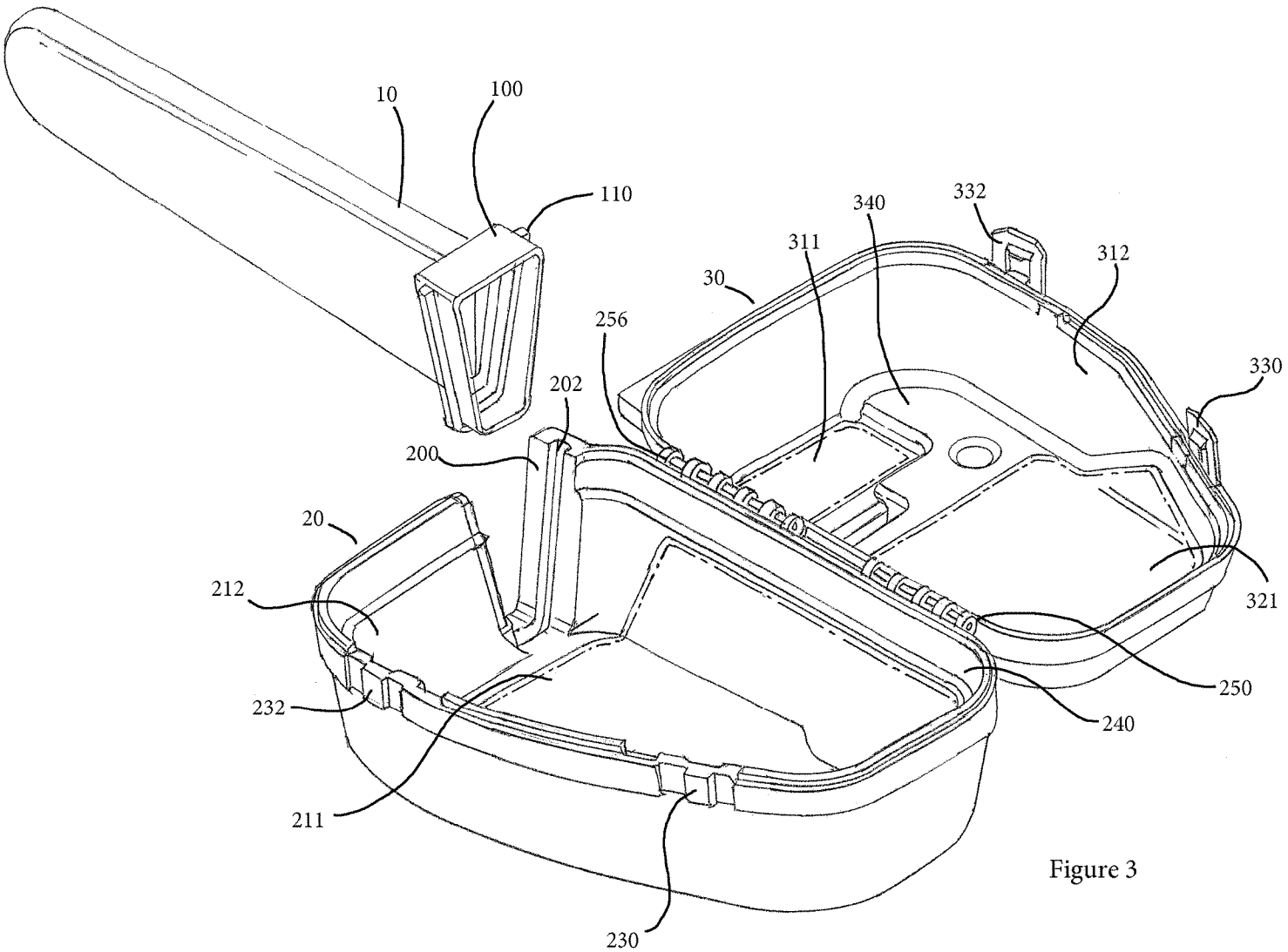
FIG. 3 is perspective view of the chainsaw case in the open position.

FIG. 3 shows a scabbard 10 with an end portion 100. The end portion is tapered to fit in an opening 200 of a bottom portion 20 of the chainsaw case. Protrusion 110 of the scabbard and recess 202 of the bottom portion interact to hold the end portion 100 in the opening 200. As shown, the opening and end portion are both tapered, which can both aid in manufacturing during the de-molding process and when placing the chainsaw having the scabbard applied thereto within the case. The tapered angle makes it easier to align the scabbard and opening. The taper can be an angle of 0-40 degrees and, preferably 1-30 degrees, more preferably 5-15 degrees and even more preferably approximately 10 degrees.

The length of the scabbard may be smaller than the distance from the inner wall of the opening to the opposite wall, thereby allowing the end portion 100 of the scabbard to be disposed so that the scabbard extends into the case during shipment or display to take up less space. Since the scabbard is removable, different length scabbards can be provided, depending on the length of the bar of the chainsaw. Optionally, an adjustable or telescoping scabbard may be used to provide for different sized chainsaws.

The bottom portion 20 contains a single wall section 210 (See FIG. 5) created by removal of cutout 211 located at the base of the bottom portion 20. A portion of the wall 212 of the bottom portion 20 located close to the opening 200 is a double wall construction. A section 240 of the bottom portion around the edge of the wall is configured as a double wall construction. Catches 230 and 232 are designed to interact with latches 330 and 332 to close the case. A double wall section similar to section 240 may be disposed around the edge of the top portion 30 as well. Hinges 250 and 256 connect the bottom 20 and top 30 portions. The top portion 30 has a double wall section 312 and single wall sections 310 and 320 (see FIG. 5) created by removal of cutouts 311 and 321. The single wall sections 310 and 320 may be located to receive sections of the chainsaw such as handles, guards or other that may extend from the body of the chainsaw. Thus, the configuration of sections 310 and 320 as single wall sections can save both space and material. A double wall section 340 is shown across the middle of the top portion 30, and this double wall section 340 is formed to receive a handle 350. The double wall section 340 provides added support to the handle section, because the weight of the chainsaw will be supported from the handle, and the location of double wall section 340 at the handle adds stiffness to the case where needed.

The cutout sections 211, 311, 321 may be removed using an in-mold punching system, where the double wall structure is molded first and while the mold is closed, a portion of the mold moves to shear or cut off the respective cutout sections 211, 311, 321 along their respective edges. Therefore, when the double wall structure is initially molded without the cutout removals, the portions of the inner wall of the double wall sections where the cutout sections will be removed are designed to work with the in-mold punching system. Often, a side wall of the section to be removed is perpendicular to the plane of the punched hole of the cutout sections 211, 311, 321 to allow for the in-mold punching to function properly. The in-mold punching system saves time during the manufacturing process, thus further reducing the cost of the case.

Based on surface area, the top portion 30 is configured with a ratio of single:double wall construction. This ratio may be 1:1 or preferably 2:1, more preferably 4:1 and even more preferably 8:1. Other ratios within the ranges of 1:1 to 8:1 are contemplated. The bottom portion 20 is also configured with a ratio of single:double wall construction. This ratio may also be 1:1 or preferably 2:1, more preferably 4:1 and even more preferably 8:1. Other ratios within these ranges are contemplated. The ratio may exceed 8:1, depending on the weight of the chainsaw and/or the level of protection required. The ratios may also be measured as beginning:remaining, where beginning represents the surface area before the punching of the double wall structure to create a single wall structure. Remaining represents the remaining surface area of the relevant wall. The ratios may be, for the inner wall of the lid or top portion 30, the beginning:remaining ratio may be in the range of 1:1-10:1 and preferrably 7.7:1. For the bottom portion 20, this beginning:remaining ratio may be in the range of 1:1-10:1 and preferably 3.4:1. The total inner surface beginning:remaining ratio may be in the range of 1:1-10:1 and preferably 4.6:1, and the total surface (inner and outer) beginning: remaining ratio may be in the range of 0.25:1-10:1 and preferably 1.63:1.

Figure 4:
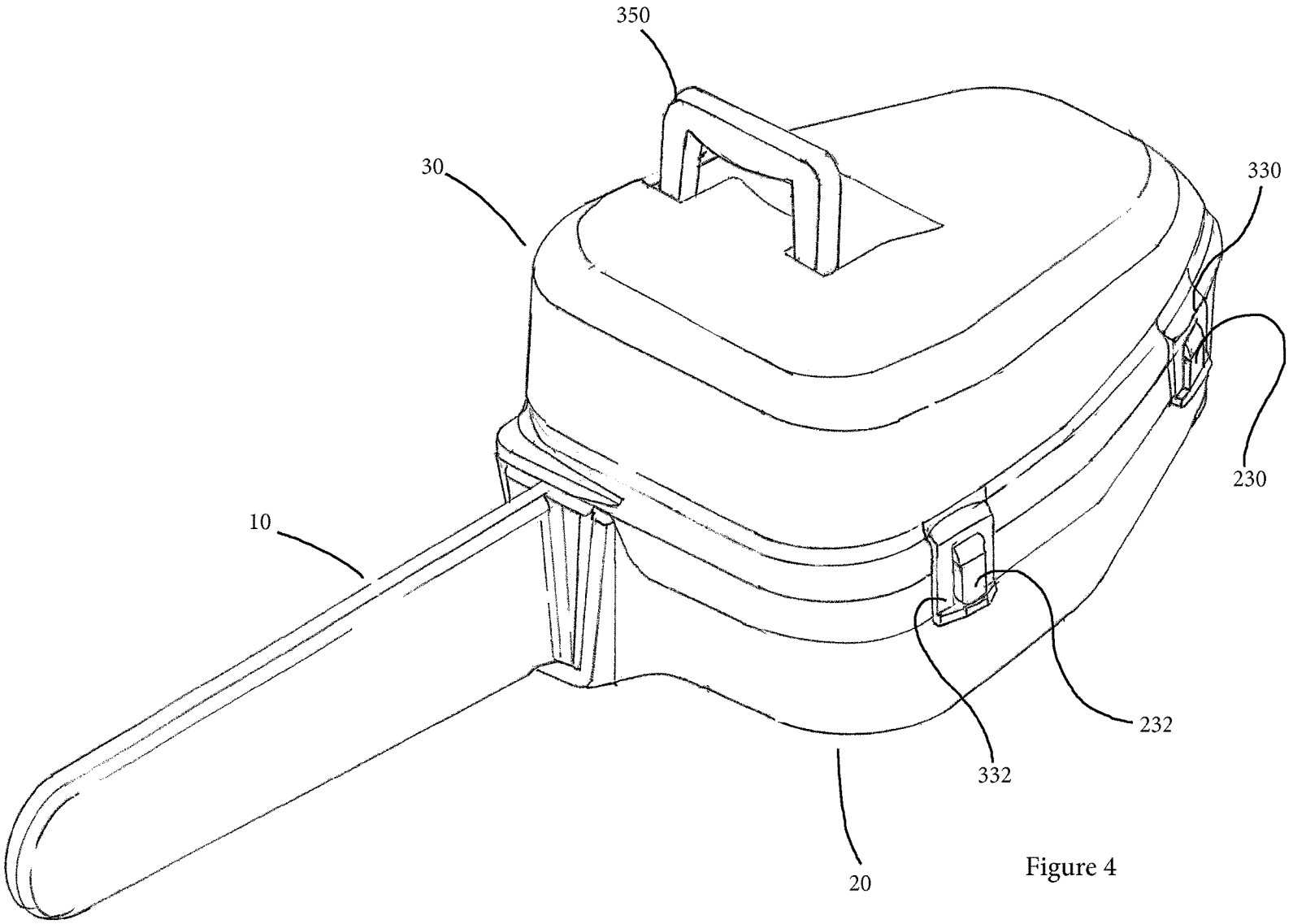
FIG. 4 is a perspective view of the chainsaw case of FIG. 3 in the closed position.

FIG. 4 shows the chainsaw case in a closed position. Handle 350 is recessed into a section of the top portion 30 so that the handle may lay flat. Also, the double wall section 340 meets at the handle to provide extra support. The scabbard 10 is installed in the bottom section 20, and the top 30 and bottom 20 sections mate along an edge with the latches 332 and 330 interacting with catches 232 and 230 to hold the case in the closed position.

Figure 5:
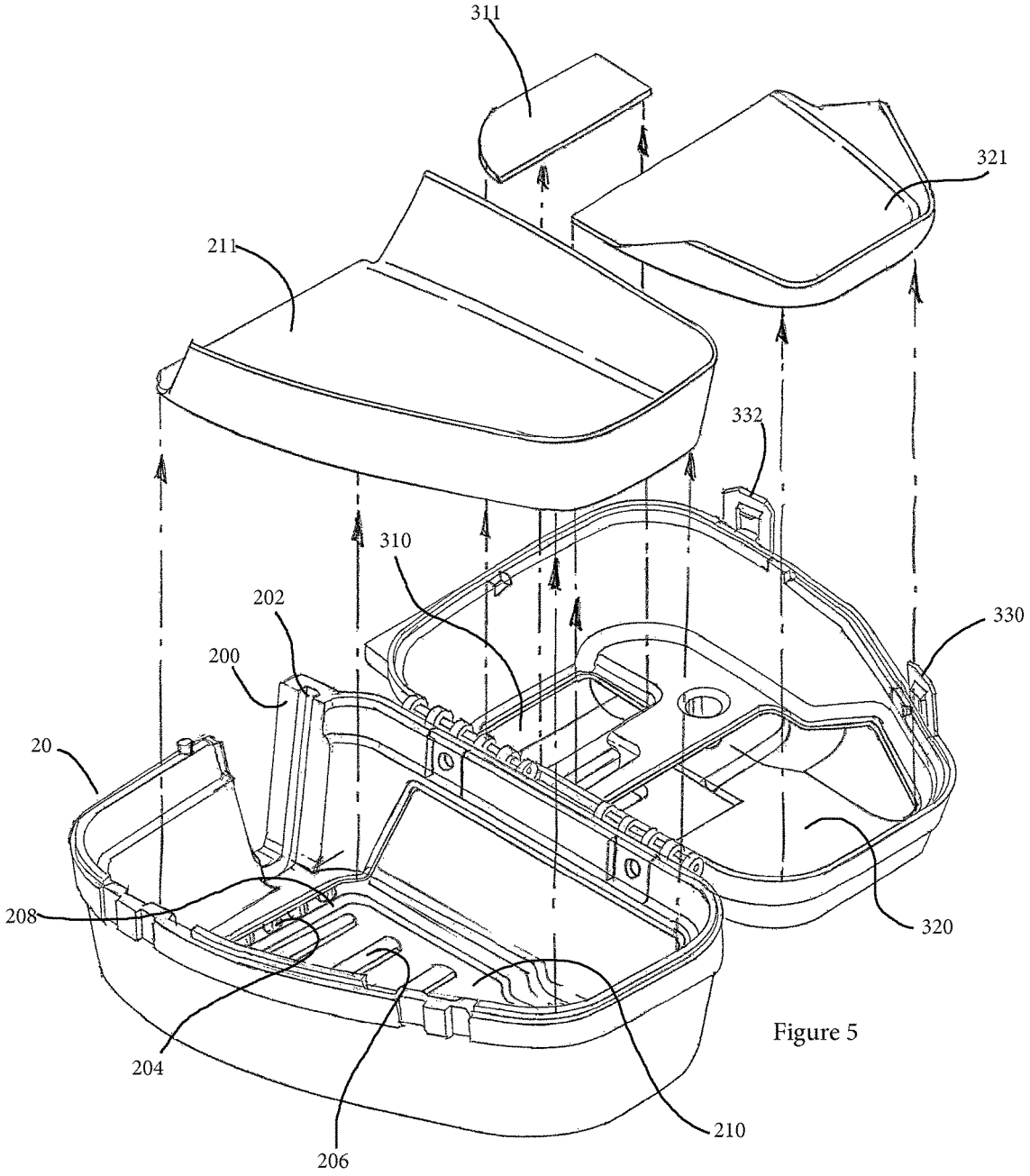
FIG. 5 is a perspective view of the case of FIG. 3 showing cutout sections.

FIG. 5 shows the cutout sections 211, 311 and 321 that are removed from the chainsaw case during manufacturing to provide the hybrid single and double wall construction. These cutout sections can be recycled into another blow molded case, thus saving material costs. The bottom portion 20 includes a base with raised sections 206 and a peripheral recess 208 that is configured to collect oil or grease from the chainsaw. Ribs 204 located near the opening 200 are formed by joining the outer wall and the inner wall near the opening to provide additional support at the opening 200. The raised sections 206 and peripheral recess 208 provide additional structure to the base of the wall that resists flexing and bending. For example, the raised sections 206 may form a corrugated type pattern that supports the weight of the chainsaw more effectively than a flat base wall without the raised sections.

Figure 6:
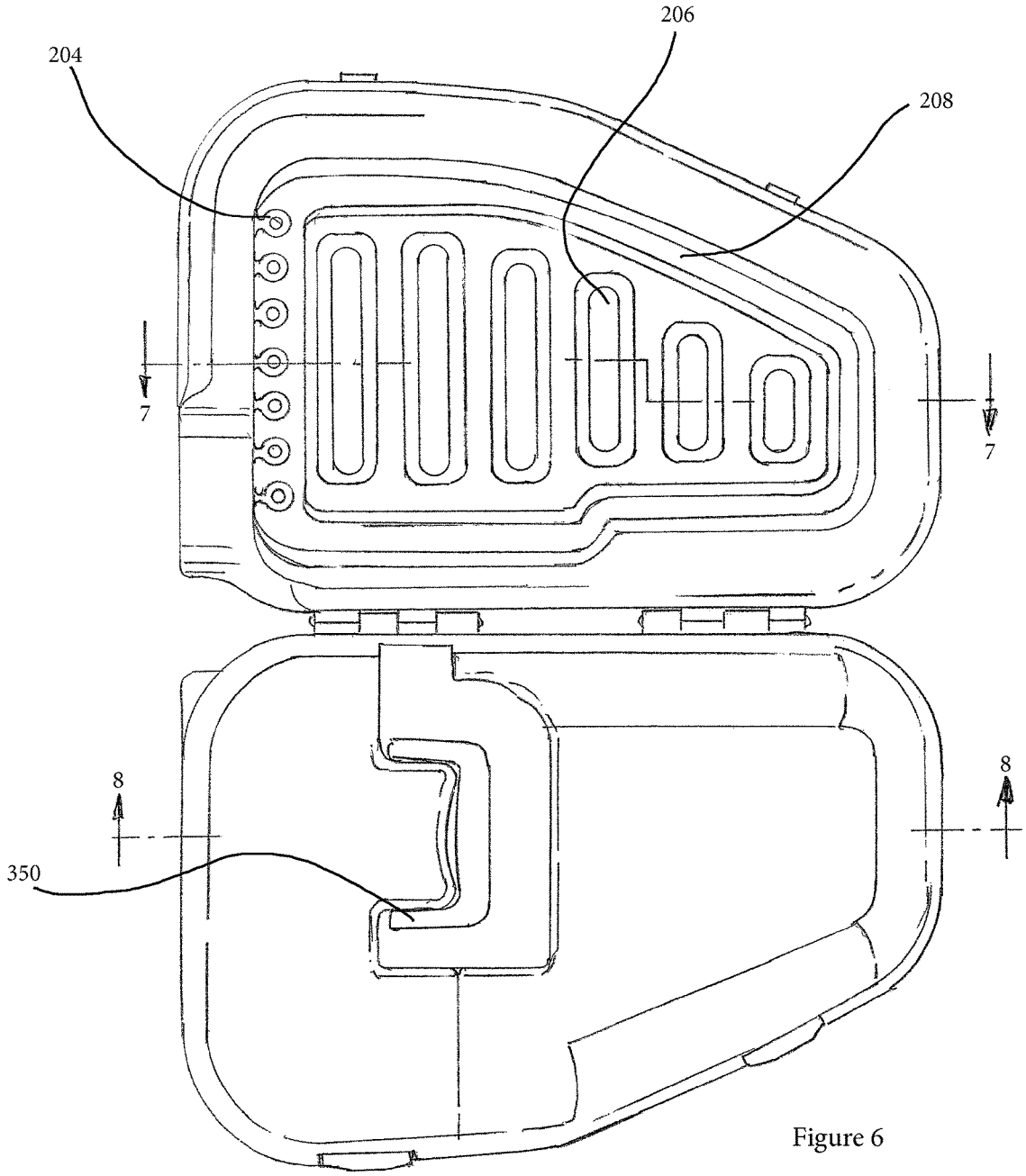
FIG. 6 is a bottom view of the chainsaw case of FIG. 3 in the open position.

FIG. 6 shows the bottom of the chainsaw case in an open position. The peripheral recess 208 and the raised sections 206 are formed in the base of the bottom portion 20. The ribs 204 are formed by joining the outer wall and the inner wall of the bottom portion near the opening 200.

Figure 7:
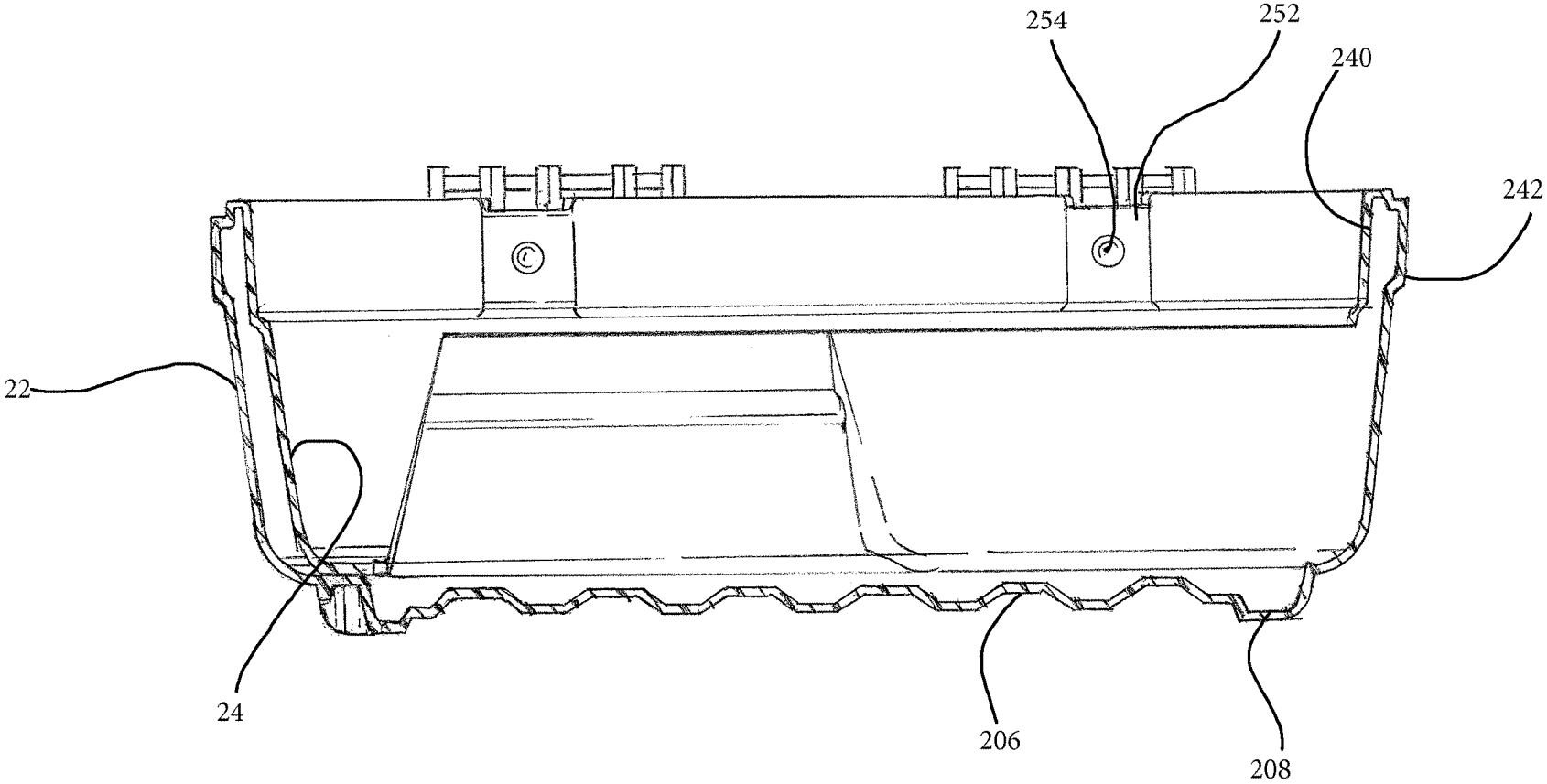
FIG. 7 is a sectional view of the chainsaw case of FIG. 3 taken along line 7-7 in FIG. 6.

FIG. 7 shows a cutaway of the bottom portion 20 along section line 7. Outer wall 22 and inner wall 24 form a double wall section near the opening 200. The ribs 204 join the outer and inner walls to provide extra support at the opening 200. The peripheral section of the inner wall 240 is positioned around the edge of the bottom section to provide additional support and to reduce the deformation of the case due to the weight of the chainsaw. Indent 252 and weld 254 support the case at the hinge where the top 30 and bottom 20 portions of the case are connected. Weld 254 may be configured to join or weld inner wall 240 and outer wall 242 near the edge of the bottom portion 20.

Figure 8:
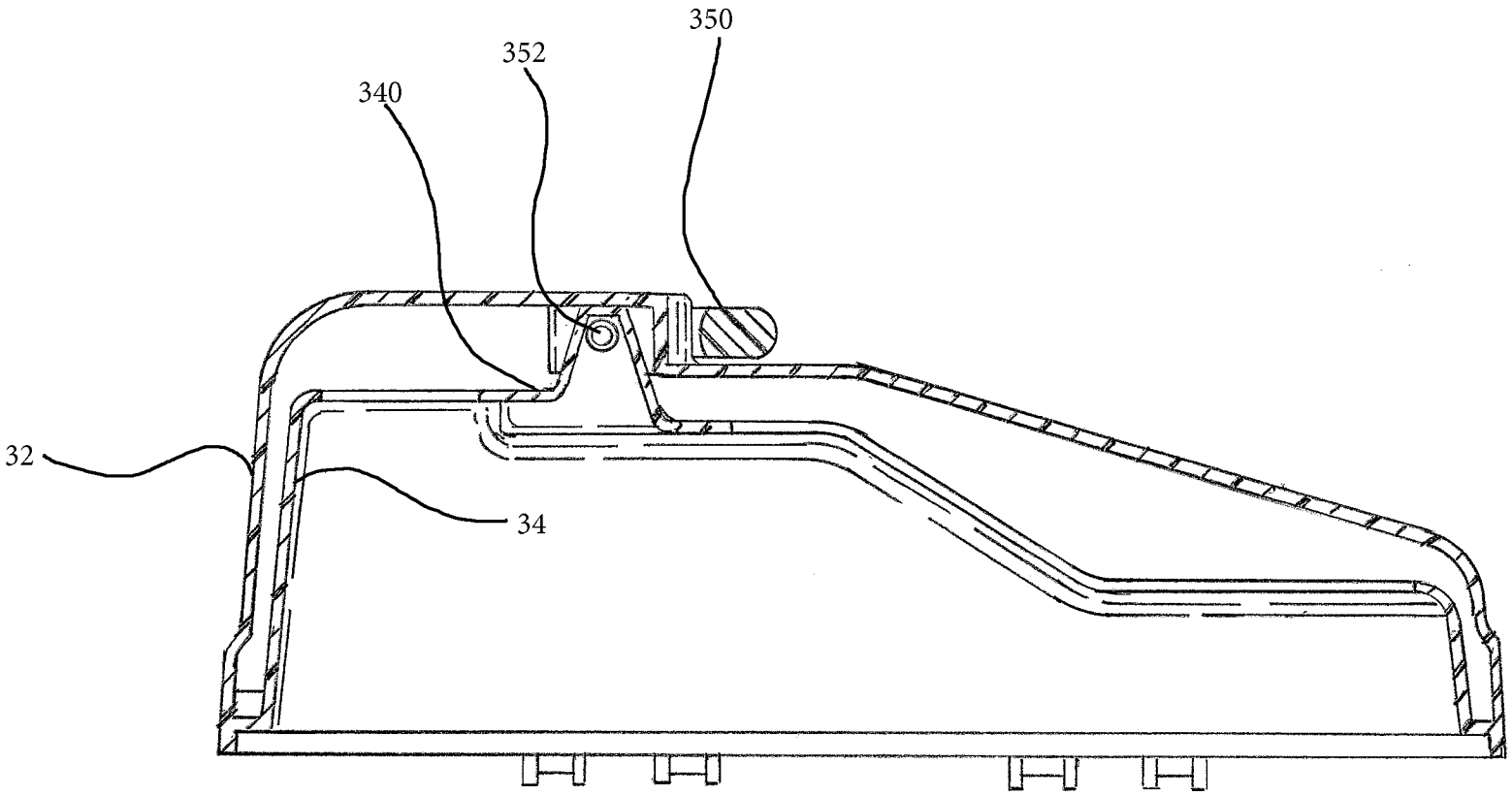
FIG. 8 is another sectional view of the chainsaw case of FIG. 3 taken along line 8-8 in FIG. 6.

FIG. 8 shows the top portion 30 having an inner 34 and outer 32 walls near the front of the case. Sections of the inner 34 wall are removed as previously discussed and shown. Double wall section 340 joins inner and outer walls at the handle 350 to provide additional support and rigidity to the chainsaw case. At the handle 350, two sections of the inner wall are each disposed at an angle, and meet at a flat section, where the flat section of the inner wall between the two angled walls joins to the outer wall for increased rigidity at the handle. The handle 350 may have an pin or pin section 352 that interacts with both the inner and outer walls, thus supporting the weight of the chainsaw. Double wall section 340 extends to the inner wall 34 of the top section 30, and therefore aids in transferring the weight from the handle to the inner wall 34 of the top section 30.

Figure 9A:
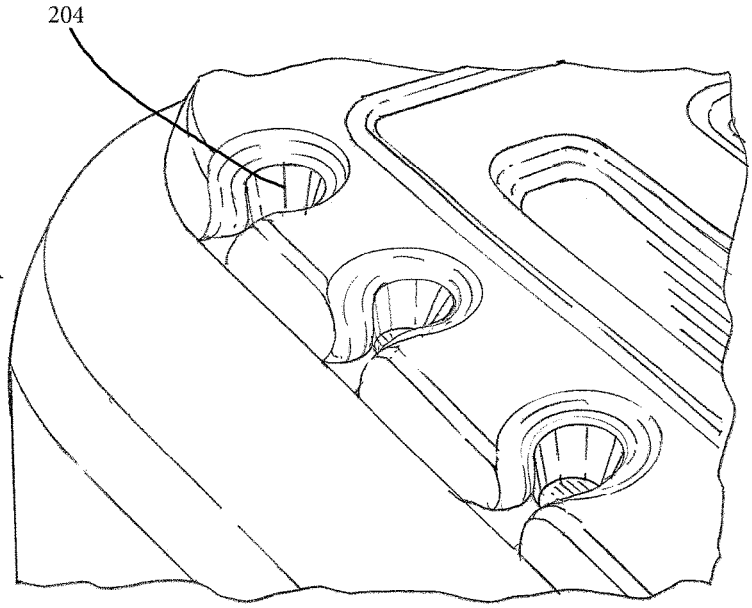
FIGS. 9A and 9B are respectively bottom and interior perspective detail views of the case of FIG. 3.
Figure 9B:
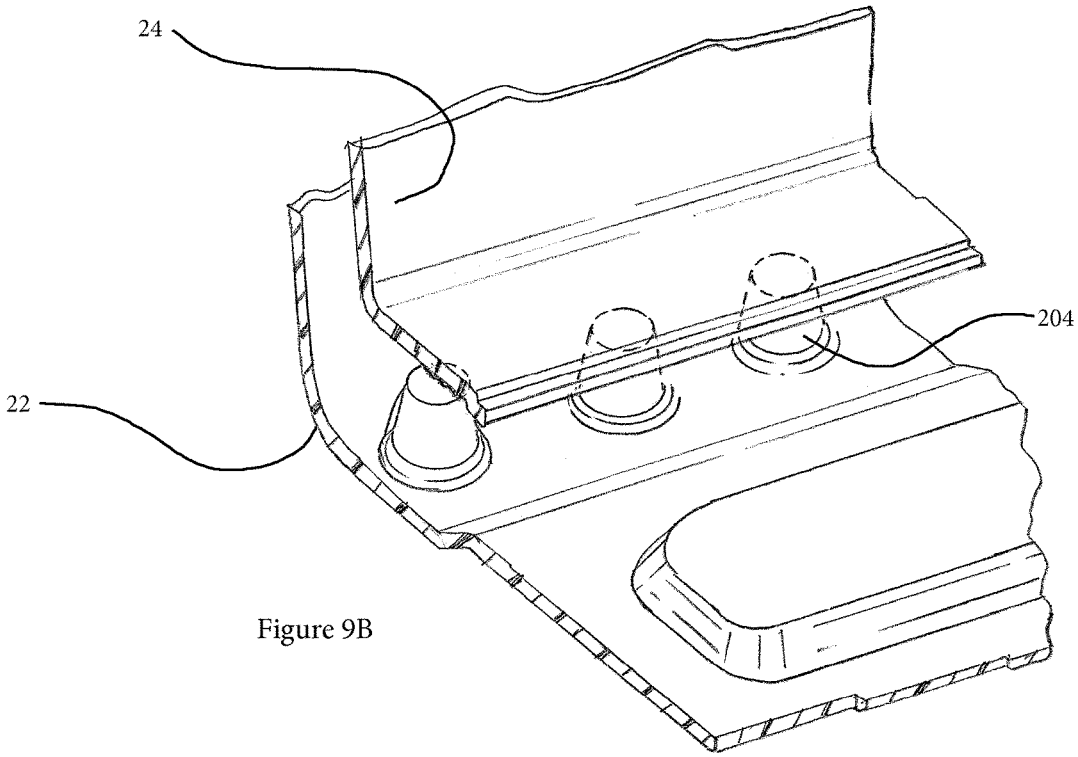

FIGS. 9A and 9B show detail of the ribs 204. The ribs may be conically shaped within the outer wall 22 and these ribs 204 are joined to the inner wall 24 to provide added stiffness and strength to the wall of the bottom portion 20 near the opening 200. The conically shaped walls of the ribs 204 meet at a flat section, and this flat section is joined to the inner wall 24. Although the ribs have been shown on the bottom portion, the ribs could be created in the top section, for example, ribs could join the double wall portion 340 on either side of the handle to provide added stiffness. Further, the ribs may be created in the inner walls so that the conical shaped walls of the ribs are within the inner wall, so that the ribs extend from the inner wall and join to the outer wall.

Figure 10A:
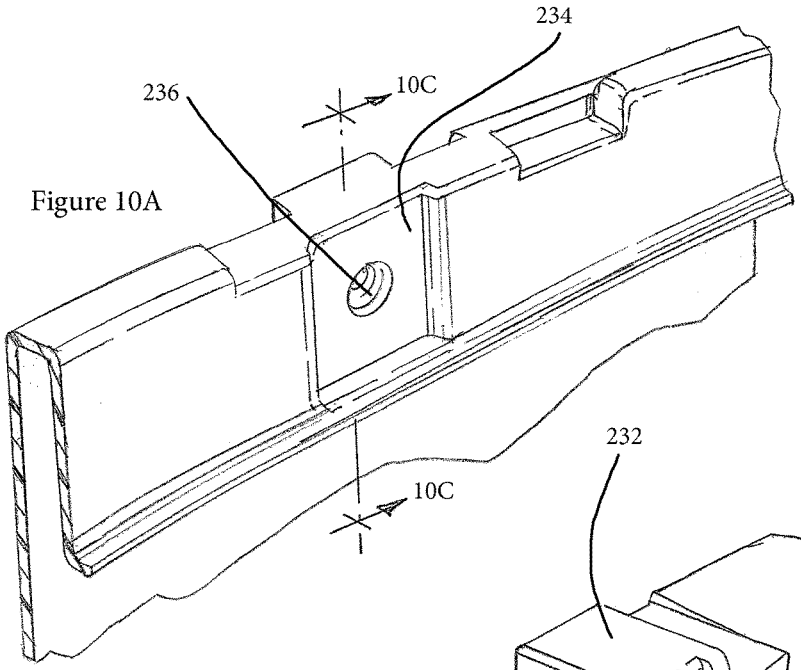
FIGS. 10A, 10B are respectively interior and exterior perspective detail views of the case of FIG. 3.
Figure 10B:
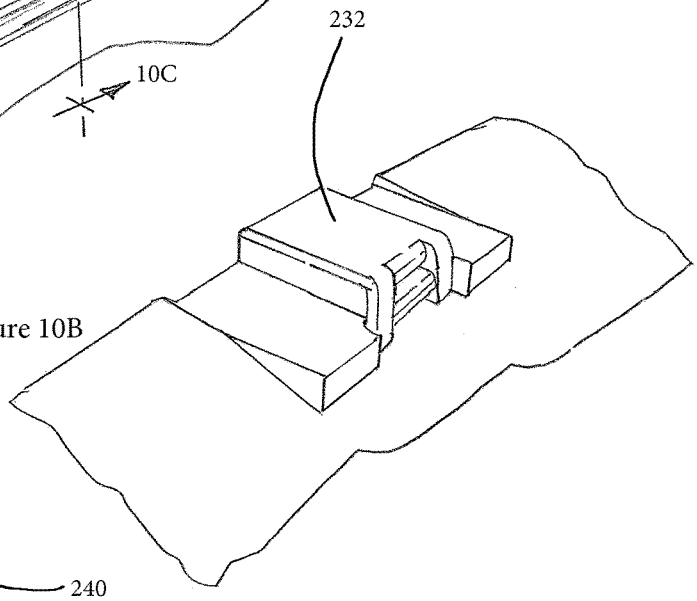
Figure 10C:
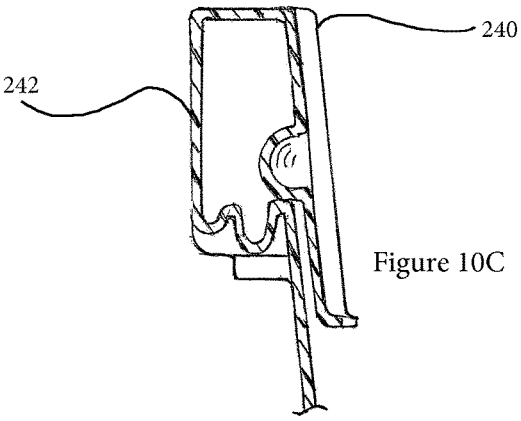
FIG. 10C is a sectional detail view of the case of FIG. 3 taken along line 10*c*-10*c* of FIG. 10*a*.

FIGS. 10A, 10B and 100 show detail views of catch 232 where indent 234 and weld 236 provide additional support to the catch 232. FIG. 100 shows a sectional view at the section line of 10A. Inner wall 240 and outer wall 242 create a double wall structure near the catch 232 to provide additional support to the case where the weight of the chainsaw will be concentrated. The weld 236 may join inner 240 and outer 242 walls for added strength. Optionally, the indent 234 and weld 236 may provide sufficient strength to not join the inner 240 and outer 242 walls as shown by FIG. 100 FIG. 11A shows the pin 256 of the hinge. FIG. 11B shows the indent 254 and weld 252 that provide additional support at the hinge. The indent and weld of the catch and the indent and weld of the hinge may have similar structures and may join or not join the inner or outer walls, depending on the required strength and stiffness for the case.

The cases described herein can also stack upon each other in the open configuration. When a majority of the base of the bottom portion 20 is configured as a single wall structure, the stacking of the cases upon each other takes up less space in comparison to a double wall structure. This results in a larger number of cases fitting in standard shipping sizes or containers, which results in a savings on shipping costs. For example, the cases may stack so that 10% more cases fit inside a pallet sized box when compared to a traditional double wall case.

What is claimed is:

1. A hybrid double and single wall case for a chainsaw having a bar, said case comprising:

a first body section and a second body section, each having a base wall and a peripheral side wall, said peripheral side walls each defining an edge wherein said first body section is a single molded piece;

said first and second body sections pivotally connected with respect to each other and adapted to pivot between an open position and a closed position, the open position to allow the chainsaw to be positioned in the case, the closed position to contain at least a majority of the chainsaw within the case;

said peripheral side wall of said first body section having an opening with two side sections, the opening extending from said edge and towards said base wall;

a scabbard having an end portion with two side sections, said side sections of said end portion adapted to mate with said side sections of said opening, said scabbard adapted to be applied to the bar of the chain saw, said end portion adapted to be received within the opening;

a portion of the first body section being configured as a double wall structure; and a portion of the first body section being configured as a single wall structure.

2. The case of claim 1 wherein at least a majority, based on surface area, of the peripheral side wall of the first body section is configured as a single wall structure.

3. The case of claim 1 wherein said first body section comprises:

said peripheral side wall having an edge section adjacent to said edge, said edge section configured as a double wall structure; and a section of said peripheral side wall, adjacent to said edge section and between said edge section and said base wall, configured as a single wall structure.

4. The case of claim 1 wherein said first body section further comprises:

said peripheral side wall configured as a single wall structure, said base wall configured as a double wall structure;

a plurality of ribs disposed between said base section and said peripheral side wall, said ribs connecting said single wall structure to said double wall structure along a portion of said peripheral side wall that includes said opening.

5. The case of claim 1 further comprising:

at least one hinge member formed on at least one of the peripheral side walls of said second body portion, each said hinge member disposed at a location where the at least one of the peripheral side walls is configured as a double wall structure.

6. The case of claim 5 further comprising:

at least one latch member formed on said peripheral side wall of one said body portions;

said at least one latch member at a location where the at least one of the peripheral side walls is configured as a double wall structure.

7. The case of claim 6 wherein walls of said double wall structure are bonded together at an area adjacent to the at least one hinge member; and wherein walls of said double wall structure are bonded together at an area adjacent to the at least one latch member.

8. The case of claim 1 further comprising:

a handle connected to said second body section;

an inner wall of said second body portion joined to an outer wall of said second body section to create a joint at said handle;

said handle extending into said second body section and contacting said inner and outer wall at said joint.

9. The case of claim 1 wherein at least one of said two side sections of said opening is disposed at an angle to form a tapered section where a width of the opening at said edge is greater than a width of the opening closer to said base, and wherein said end portion of said scabbard is tapered.

10. A hybrid double and single wall case for a chainsaw having a bar and at least one grip section at a proximal end, said case comprising:

a first body section and a second body portion, each having a base wall and a peripheral side wall, said peripheral side wall defining an edge;

said first and second body sections pivotally connected with respect to each other and adapted to pivot between an open position and a closed position, the open position to allow the chainsaw to be positioned in the case, and the closed position to contain at least a majority of the chainsaw within the case;

said peripheral side wall of said first body section having an opening extending from said edge and towards said base;

a scabbard having an end portion and adapted to be applied to the bar of the chain saw, said end portion adapted to be received within the opening;

a portion of each said first and second body sections being configured as a double wall structure; and a portion of each said first and second body sections being configured as a single wall structure;

wherein the portion of said second body section configured as a single wall structure creates at least one pocket surrounded by said double wall structure, each said pocket adapted to receive at least one of the grip sections.

11. The carrying case of claim 10 wherein at least a majority, based on surface area, of the peripheral side wall of the first body section is configured as a single wall structure.

12. The carrying case of claim 10 wherein said first body section comprises:

said peripheral side wall having a edge section adjacent to said edge, said edge section configured as a double wall structure; and a section of said peripheral side wall, adjacent to said edge section and between said edge section and said base wall, configured as a single wall structure.

13. The carrying case of claim 10 wherein said first body section further comprises:

said peripheral side wall configured as a single wall structure, said base wall configured as a double wall structure;

a plurality of ribs disposed between said base section and said peripheral side wall, said ribs connecting said single wall structure to said double wall structure along a portion of said peripheral side wall that includes said opening.

14. The carrying case of claim 10 further comprising:

at least one hinge member formed on at least one of the peripheral side walls of said second body section, said at least one hinge member disposed at a location where the at least one of the peripheral side walls is configured as a double wall structure.

15. The carrying case of claim 14 further comprising:

at least one latch member formed on said peripheral side wall of one said body sections;

said at least one latch member at a location where the at least one of the peripheral side walls is configured as a double wall structure.

16. The carrying case of claim 15 wherein walls of said double wall structure are bonded together at an area adjacent to the at least one hinge member; and wherein walls of said double wall structure are bonded together at an area adjacent to the at least one latch member.

17. The carrying case of claim 10 further comprising:

a handle connected to said second body section;

an inner wall of said second body section joined to an outer wall of said second body section to create a joint at said handle;

said handle extending into said second body section and contacting said inner and outer wall at said joint.

18. The case of claim 10 wherein at least one of said two side sections of said opening is disposed at an angle to form a tapered section where a width of the opening at said edge is greater than a width of the opening closer to said base, and wherein said end portion of said scabbard is tapered.

19. A hybrid double and single wall case for a chainsaw having a bar, said case comprising:

a first body section and a second body section, each having a base wall and a peripheral side wall, said peripheral side walls each defining an edge, wherein said first body portion is a single molded piece;

said first and second body sections pivotally connected with respect to each other and adapted to pivot between an open position and a closed position, the open position to allow the chainsaw to be positioned in the case, and the closed position to contain at least a majority of the chainsaw within the case;

said peripheral side wall of said first body portion having an opening extending from said edge and towards said base wall;

a scabbard having an end portion and adapted to be applied to the bar of the chain saw, said end portion adapted to be received within the opening;

a portion of the first body section being configured as a double wall structure;

wherein at least a majority, based on surface area, of the base wall of the first body section being configured as a single wall structure.

20. The case of claim 19 further comprising:

said peripheral side wall of said first body section having an edge section adjacent to said edge of said first body section, said edge section configured as a double wall structure; and a section of said peripheral side wall of said first body section, adjacent to said edge section of said first body section and between said edge section and said base wall of said first body section, configured as a single wall structure;

at least one latch member formed on said peripheral side wall of one said body portions;

at least one hinge member formed on said peripheral side wall of one said body portions;

each latch member and each hinge member being disposed at a location where the at least one of the peripheral side walls is configured as a double wall structure;

wherein an outer and an inner wall of said double wall structure are joined together at an area adjacent to each said latch member.

21. The case of claim 1 wherein the single wall structure is formed by removal of a section of a wall of the single molded piece.

22. The case of claim 19 wherein the single wall structure is formed by removal of a section of a wall of the single molded piece.

* * * * *